US006156104A

United States Patent [19]

Jeong

[11] Patent Number: 6,156,104

[45] Date of Patent: Dec. 5, 2000

[54] ELECTRICAL DUST COLLECTOR HAVING A MEMBER FOR INSULATING THE SPACE BETWEEN A HIGH VOLTAGE WIRE AND A GROUNDING MEMBER

[75] Inventor: Young Wook Jeong, Suwon, Rep. of Korea

[73] Assignee: Samsung Electronics Co., Ltd., Suwon, Rep. of Korea

[21] Appl. No.: 09/217,576

[22] Filed: Dec. 21, 1998

[30] Foreign Application Priority Data

Dec. 27, 1997 [KR] Rep. of Korea ..... 97-75544

[51] Int. Cl.[7] ..... B03C 3/70

[52] U.S. Cl. ..... 96/88; 96/90; 96/96

[58] Field of Search ..... 96/88, 90, 96

[56] References Cited

U.S. PATENT DOCUMENTS

| | | | |
|---|---|---|---|
| 3,495,379 | 2/1970 | Hall et al. | 96/88 X |
| 4,071,688 | 1/1978 | Lynch et al. | 96/88 |
| 4,167,400 | 9/1979 | Onushco | 96/88 |
| 4,349,359 | 9/1982 | Fitch et al. | 96/96 X |
| 4,666,474 | 5/1987 | Cook | 96/96 X |
| 5,421,863 | 6/1995 | Rector et al. | 96/88 X |

FOREIGN PATENT DOCUMENTS

| | | | |
|---|---|---|---|
| 54-156277 | 12/1979 | Japan | 96/88 |
| 4-317754 | 11/1992 | Japan | 96/96 |
| 2016305 | 9/1979 | United Kingdom | 96/96 |

*Primary Examiner*—Richard L. Chiesa
*Attorney, Agent, or Firm*—Burns, Doane, Swecker & Mathis, L.L.P.

[57] ABSTRACT

An electrical dust collector has an ionization section for ionizing dust in air, and a collection section for collecting the ionized dust. The ionization section includes a high voltage wire to which a high voltage is applied, and a grounding member disposed near the high voltage wire so as to be spaced by a predetermined distance. An insulating member is disposed between the high voltage wire and the grounding member. The insulating member electrically insulates the space between the grounding member and at least an end of the high voltage line. An electrical discharge between the high voltage wire and the grounding member is prevented by the insulating member, whereby the operation of the electrical dust collector is stabilized.

11 Claims, 3 Drawing Sheets

ELECTRICAL DUST COLLECTOR HAVING A MEMBER FOR INSULATING THE SPACE BETWEEN A HIGH VOLTAGE WIRE AND A GROUNDING MEMBER

BACKGROUND OF THE INVENTION

1. Field of the Invention

The present invention relates to an electrical dust collector, and more particularly, to an electrical dust collector capable of preventing an electrical discharge by insulating the space between a high voltage wire and a grounding member.

2. Prior Art

An electrical dust collector is an apparatus for cleaning air in a room by removing dust in the air. Such an electrical dust collector generally has an ionization section for ionizing dust in air drawn thereinto, a high voltage generation section for supplying a high voltage to the ionization section, and a collection section for collecting the ionized dust.

As shown in FIGS. 4 and 5, the ionization section 110 of the electrical dust collector has a plurality of high voltage wires 115 disposed in a frame 102 of the electrical dust collector, and a grounding member 113 for forming an electric field between the high voltage wires 115. The high voltage wires 115 are generally made of tungsten.

The high voltage wires 115 are horizontally disposed in parallel with each other. A power supply bracket 118 for supplying electrical power to the high voltage wires 115 is installed at an inner side of the frame 102. Springs 116 are connected to both ends of each high voltage wire 115, and the springs 116 are fixed to the power supply bracket 118.

The grounding member 113 comprises a plurality of grounding plates 112 and a pair of connection flanges 111 which interconnect the grounding plates 112 at both ends thereof.

The grounding plates 112 are disposed horizontally between respective high voltage wires 115.

When the high voltage generation section supplies the ionization section 110 with a high voltage of about 5,000 volts, an electric field is generated toward the grounding plates 112 by the high voltage wires 115. The dust passing through the ionization section 110 is positively ionized by the electric field. The ionized dust is collected by the collection section.

In order to generate an electric field to optimize the ionization of the dust, the high voltage wires 115 and the grounding plates 112 are disposed so as to maintain an optimal distance from each other. If the high voltage wires 115 and the grounding plates 112 are closer to each other than an optimal distance, an electrical discharge may occur due to an unstable insulation therebetween, and if the high voltage wires 115 and the grounding plates 112 are too distant from each other, an optimal electric field to ionize the dust cannot be achieved.

However, in such a conventional electrical dust collector, the distance between the connection flanges 111 and ends of the high voltage wires 115 is inevitably closer than an optimal distance due to a structural consideration of the electrical dust collector, so an electrical discharge may occur between the ends of the high voltage wires 115 and the connection flanges 111.

SUMMARY OF THE INVENTION

The present invention has been proposed to overcome the above-described problems in the prior art, and accordingly, it is the object of the present invention to provide an electrical dust collector capable of preventing an electrical discharge between a high voltage wire and a grounding member.

To achieve the above object, the present invention provides an electrical dust collector comprising: an ionization section for ionizing dust in air. The ionization section includes a high voltage wire for receiving a high voltage; a grounding member disposed near the high voltage wire and spaced therefrom by a predetermined distance; and an electrically insulating member disposed between the high voltage wire and the grounding member for electrically insulating a space between the grounding member and at least one end of the high voltage wire.

Preferably, there are a plurality of high voltage wires disposed in parallel relationship with each other. The grounding member includes a plurality of grounding plates each situated between two adjacently disposed ones of the high voltage wires and extending parallel thereto. The grounding member further includes a connection flange interconnecting the grounding plates. The insulating member is disposed between the connecting flange and end portions of the high voltage wires.

The insulating member preferably has a sheet-like configuration and is attached to the connection flange.

The insulating member preferably includes a plurality of tongues. Each tongue extends adjacent to a respective high voltage wire in parallel relationship thereto for a predetermined distance.

Preferably, the insulating member is made of polyethylene.

According to the present invention, the high voltage wires and the grounding member are electrically insulated from each other by the insulating member. Therefore, and electrical discharge between the high voltage wires and the grounding member is prevented and the electrical dust collector operates in a stable manner.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the accompanying drawings.

Figure 1:
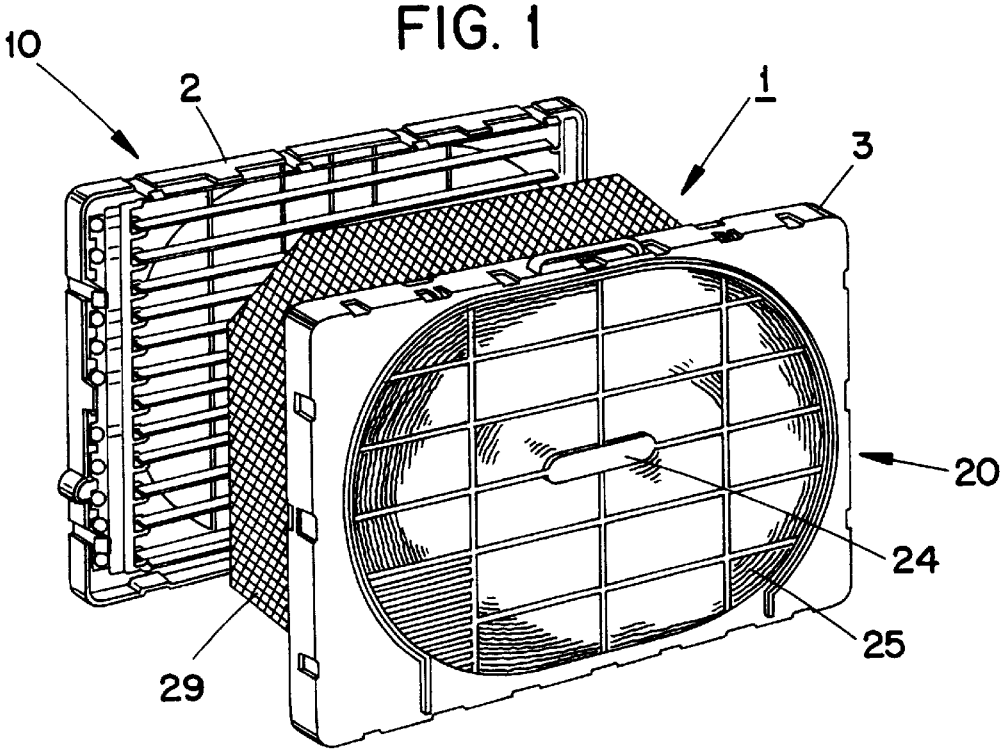
FIG. 1 is an exploded perspective view of an electrical dust collector according to the present invention.

FIG. 1 is an exploded perspective view of an electrical dust collector according to the present invention.

The electrical dust collector 1 has an ionization section 10 for ionizing dust in air, a high voltage generation section (not shown) for supplying a high voltage into the ionization section 10, and a collection section 20 for collecting the ionized dust. The ionization section 10 is disposed on the front side of the electrical dust collector 1, and the collection section 20 is disposed on the rear side of the electrical dust collector 1. Between the ionization section 10 and the collection section 20, a screen 29 made of an aluminium web is disposed.

The collection section 20 has a rectangular rear frame 3, collection strips 25 installed in the rear frame 3, and a fixing part 24 for fixing the collection strips 25 in the rear frame 3.

The fixing part 24 is formed at the central area of the rear frame 3, and the collection strips 25 are wound around the fixing part 24 along the circumferential direction of the rear frame 3. The collection strips 25 are comprised of a first collection strip (not shown) and a second collection strip (not shown), and they are wound around the fixing part 24 together. Accordingly, the first and the second collection strips are disposed in turn along the radial direction from the fixing part 24. In general, the first collection strip is made of aluminium, and the second collection strip is made of aluminium coated with a resin such as polyethylene.

Figure 2:
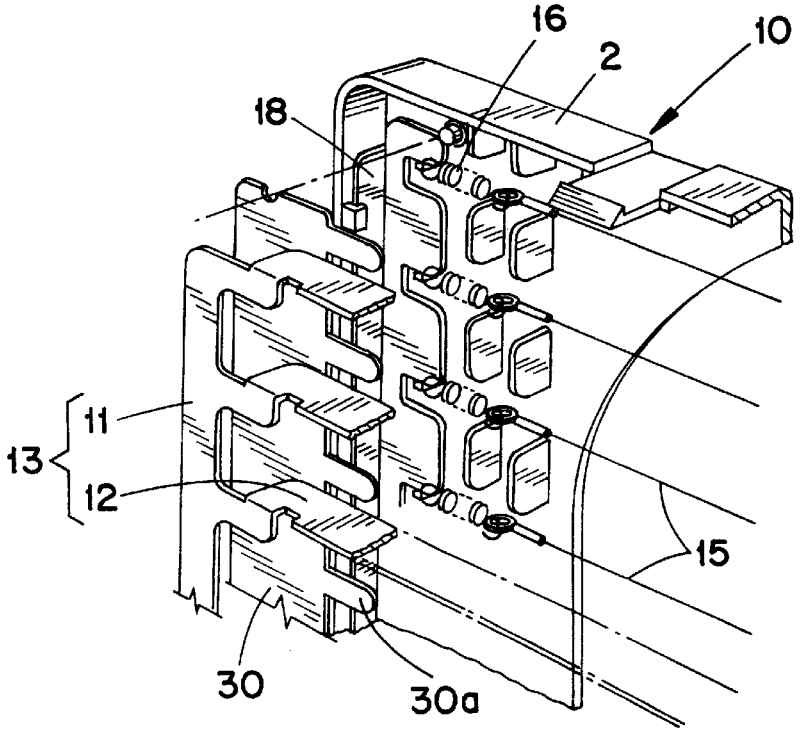
FIG. 2 is an enlarged exploded perspective view of an ionization section shown in FIG. 1.
Figure 3:
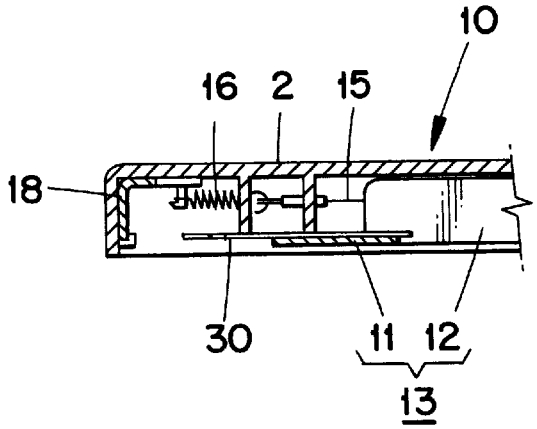
FIG. 3 is a sectional view of the assembled state of FIG. 2.
Figure 4:
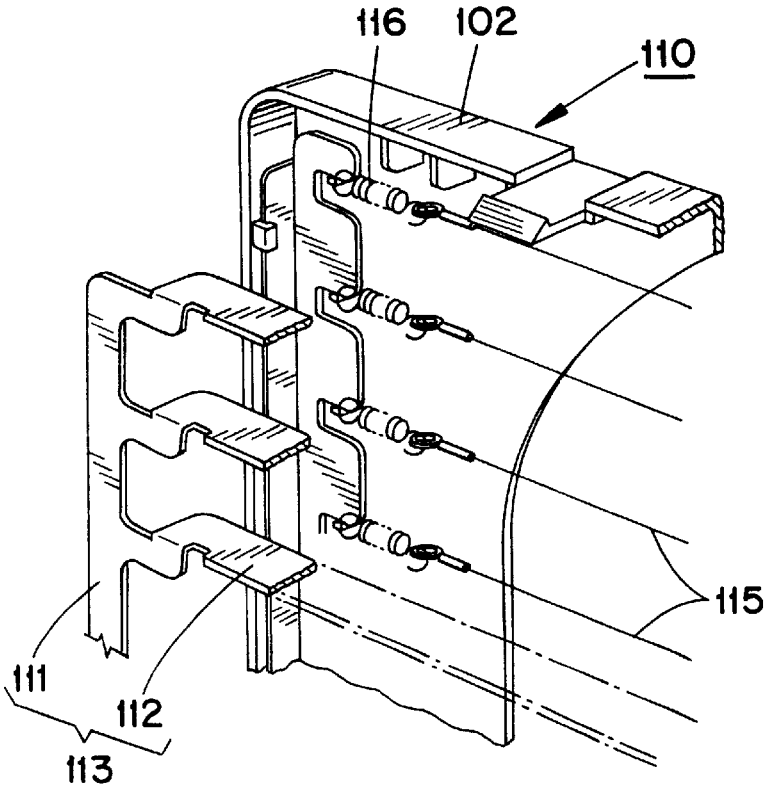
FIG. 4 (PRIOR ART)
FIG. 4 is an exploded perspective view of an ionization section of a conventional electrical dust collector.
Figure 5:
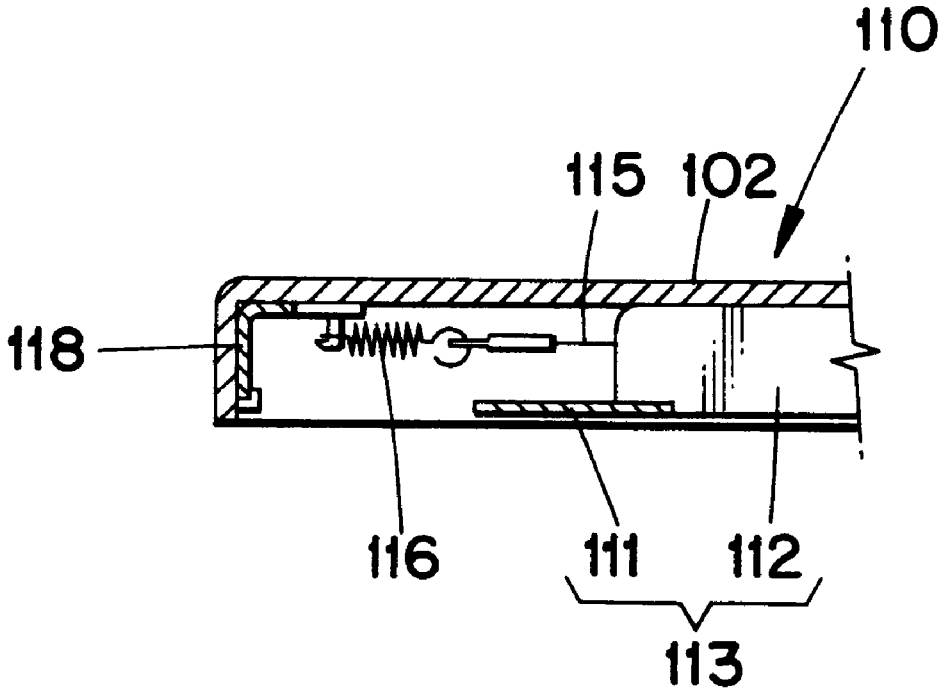
FIG. 5 (PRIOR ART)
FIG. 5 is a sectional view of the assembled state of FIG. 4.

Meanwhile, the ionization section 10 has, as shown in FIGS. 2 and 3, a rectangular front frame 2 assembled to the front side of the rear frame 3 of the collection section 20, a plurality of high voltage wires 15 disposed in the front frame 2, and a grounding member 13 for forming an electric field between the high voltage wires 15. The high voltage wires 15 are generally made of tungsten.

The high voltage wires 15 are horizontally disposed in parallel with each other. A power supply bracket 18 for supplying electrical power to the high voltage wires 15 is installed at an inner side of the front frame 2. Springs 16 are connected to both ends of each high voltage wire 15, and the springs 116 are fixed to the power supply bracket 18. By the springs 16, the high voltage wires 15 are connected to the power supply bracket 18.

The grounding member 13 comprises a plurality of grounding plates 12 and a pair of connection flanges 11 for interconnecting the grounding plates 12 at both ends thereof. The grounding plates 12 are horizontally disposed between respective high voltage wires 15 so as to be spaced from the high voltage wires 15 by a predetermined distance. The length of respective grounding plates 12 is similar to that of the high voltage wires 15. The connection flanges 11 are disposed at both sides of the front frame 2 and are extended vertically.

Between the connector: flanges 11 and the high voltage wires 15, an insulating member 30 to electrically insulate them is disposed. The insulating member 30 is made of a resin such as polyethylene. The width of insulating member 30 is broader than that of the connection flange 11, so it insulates the connection flange 11 from both ends of the high voltage wires 15.

Preferably, the insulating member 30 is a sheet-like configuration and is attached to the connection flange 11 as shown in FIGS. 2 and 3. Furthermore, the insulating member 30 has a plurality of tongues 30*a* extended along the grounding plates 12 with a predetermined length. Therefore, the insulating member 30 insulates the space between the connection flange 11 and the high voltage wires 15 as well as between the high voltage wires 15 and the ends of the grounding plates 12.

Thus, the connection flange 11 lies in a plane oriented transversely relative to the planes of respective grounding plates and parallel to a plane of the insulating member 30. The flange 11 is situated on a side of the insulating member facing away from the wires 15, and the grounding plates pass through the plane of the insulating member to be situated on an opposite side of the insulating member.

When the high voltage generation section supplies the ionization section 10 with a high voltage of about 5,000 volts, an electric field is generated from the high voltage wires 15 to the grounding plates 12. The dust passing through the ionization section 10 is positively ionized by the electric field. In this situation, since the insulating member 30 is disposed between the high voltage wires 15 and the grounding member 13, the high voltage wires 15 and the grounding member 13 are electrically insulated from each other, whereby an electrical discharge therebetween is prevented. Therefore, the operation of the electrical dust collector 1 is stabilized.

The dust ionized by the ionization section 10 is then drawn into the collection section 20. The first collection strip in the collection section 20 is grounded and the second collection strip in the collection section 20 is applied with a high voltage. Therefore, the positive ions drawn into the collection section 20 are collected onto the first collection strip. Then, clean air in which the dust has been removed, is supplied into a room from the collection section 20.

According to the present invention, since the high voltage wires 15 and the grounding member 13 are electrically insulated by the insulating member 30, an electrical discharge therebetween is prevented and the electrical dust collector 1 operates in a stable manner.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. An electrical dust collector comprising:

an ionization section having a rectangular first frame, a high voltage wire part installed in the first frame for receiving a high voltage, and a grounding member disposed near the high voltage wire part and spaced therefrom by a predetermined distance, for ionizing dust in the air of the ionization section;

a planar sheet-shaped electrically insulating member disposed between the high voltage wire part and the grounding member, for electrically insulating the grounding member and an end of the high voltage wire part with respect to each other; and a dust collection section having a second frame coupled to the first frame, a dust collection plate in the second frame, and a fixing part for fixing the dust collection plate to the second frame;

wherein the insulating member and the first frame are detachable from each other.

2. The electrical dust collector according to claim 1, wherein the high voltage wire part has a plurality of high voltage wires disposed in parallel with each other, the grounding member including a plurality of grounding plates each situated between adjacently disposed high voltage wires in parallel thereto, and a connecting flange interconnecting the grounding plates; the insulating member being disposed between the connecting flange and end portions of the high voltage wires.

3. The electrical dust collector according to claim 2, wherein the insulating member has a planar sheet shape and is attached to the connection flange.

4. The electrical dust collector according to claim 3, wherein the insulating member includes a plurality of tongues, each tongue extending adjacent to a respective high voltage wire in parallel thereto and having a predetermined distance.

5. The electrical dust connector according to claim 4, wherein the insulating member and the frame are made of different respective materials.

6. The electrical dust collector according to claim 5, wherein the insulating member is made of polyethylene.

7. An electrical dust collector comprising:

an ionization section having a high voltage wire part for receiving a high voltage, and a grounding member disposed near the high voltage wire part and spaced therefrom by a predetermined distance, for ionizing dust in the air of the ionization section, the grounding member including a flange and a grounding plate lying in respective first and second planes oriented transversely relative to one another;

an electrically insulating member for electrically insulating the grounding member and an end of the high voltage wire part with respect to each other, the insulating member including a planar portion lying in a third plane oriented substantially parallel to the first plane, wherein the flange is situated on a side of the planar portion facing away from the high voltage wire part, and the grounding plate passes through the third plane to be disposed on an opposite side of the planar portion.

8. An electrical dust collector comprising an ionization section for ionizing dust in air, the ionization section including:

a plurality of parallel high voltage wires for receiving a high voltage;

a grounding member disposed near the high voltage wires and spaced therefrom by a predetermined distance, the grounding member including a plurality of grounding plates each situated between adjacently disposed ones of the high voltage wires and extending parallel thereto, and a connecting flange interconnecting the grounding plates; and an electrically insulating member disposed between the high voltage wire and the grounding plates for electrically insulating a space disposed between the connecting flange and end portions of the high voltage wires.

9. The electrical dust collector according to claim 8, wherein the insulating member has a planar sheet configuration and is attached to the connection flange.

10. The electrical dust collector according to claim 9, wherein the insulating member includes a plurality of tongues, each tongue extending adjacent to a respective high voltage wire in parallel relationship thereto for a predetermined distance.

11. The electrical dust collector according to claim 8, wherein the insulating members is made of polyethylene.

* * * * *